US010569839B1

(12) United States Patent
Thomson et al.

(10) Patent No.: US 10,569,839 B1
(45) Date of Patent: Feb. 25, 2020

(54) DEPTH-TOLERANT, INFLATABLE, VARIABLE-BUOYANCY BUOY

(71) Applicant: United States of America as represented by the Secretary of the Navy, San Diego, CA (US)

(72) Inventors: Bret R. Thomson, San Diego, CA (US); Brandon J. Wiedemeier, San Diego, CA (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 16/143,664

(22) Filed: Sep. 27, 2018

(51) Int. Cl.
*B63B 22/18* (2006.01)

(52) U.S. Cl.
CPC ..... *B63B 22/18* (2013.01); *B63B 2207/02* (2013.01)

(58) Field of Classification Search
CPC ..... B63B 22/18; B63B 22/22; B63B 2207/02
See application file for complete search history.

(56) References Cited

U.S. PATENT DOCUMENTS 3,648,312 A * 3/1972 May ..... F42B 19/44 441/30
3,706,294 A * 12/1972 Radford ..... B63C 7/10 114/20.1
4,271,552 A * 6/1981 Sandler ..... B63B 22/00 114/20.1
5,460,556 A * 10/1995 Logan ..... B63B 22/18 441/2
6,309,269 B1 10/2001 Fulton
6,481,378 B1 11/2002 Zemach
6,739,266 B1 * 5/2004 Castano ..... F42B 10/38 102/399
7,250,568 B1 * 7/2007 Dow ..... F42B 10/50 114/20.1
8,561,398 B2 10/2013 Capone
9,061,739 B1 * 6/2015 Thomson ..... B63B 22/20
9,272,756 B1 3/2016 Thompson
9,410,559 B2 * 8/2016 VanWalleghem ..... F17C 1/007
2011/0220001 A1 * 9/2011 Bossert ..... B63B 22/18 114/321
2018/0057166 A1 * 3/2018 Lloyd ..... B64D 17/38

FOREIGN PATENT DOCUMENTS

WO WO-9427339 A1 * 11/1994 ..... B63B 22/18

* cited by examiner

*Primary Examiner* — Anthony D Wiest
(74) *Attorney, Agent, or Firm* — Naval Information Warfare Center Pacific; Kyle Eppele

(57) ABSTRACT

A buoy, comprising a body, an inflatable bladder, a bladder cover, a pressure vessel, a variable-volume, gas-filled chamber, a controller, a compressor, and a ballast. The bladder cover surrounds the inflatable bladder. When the inflatable bladder is deflated, the bladder cover is configured to compress the inflatable bladder so as to conform to an exterior contour of the body. The variable-volume, gas-filled chamber provides passive, variable buoyancy to the buoy. The controller is configured to control a transfer of compressible gas between the inflatable bladder and the first pressure vessel. The compressor is configured to remove gas from the inflatable bladder, compress the removed gas, and introduce the compressed gas to the first pressure vessel for storage. The ballast maintains a substantially vertical orientation of the buoy when the buoy is in water.

20 Claims, 6 Drawing Sheets

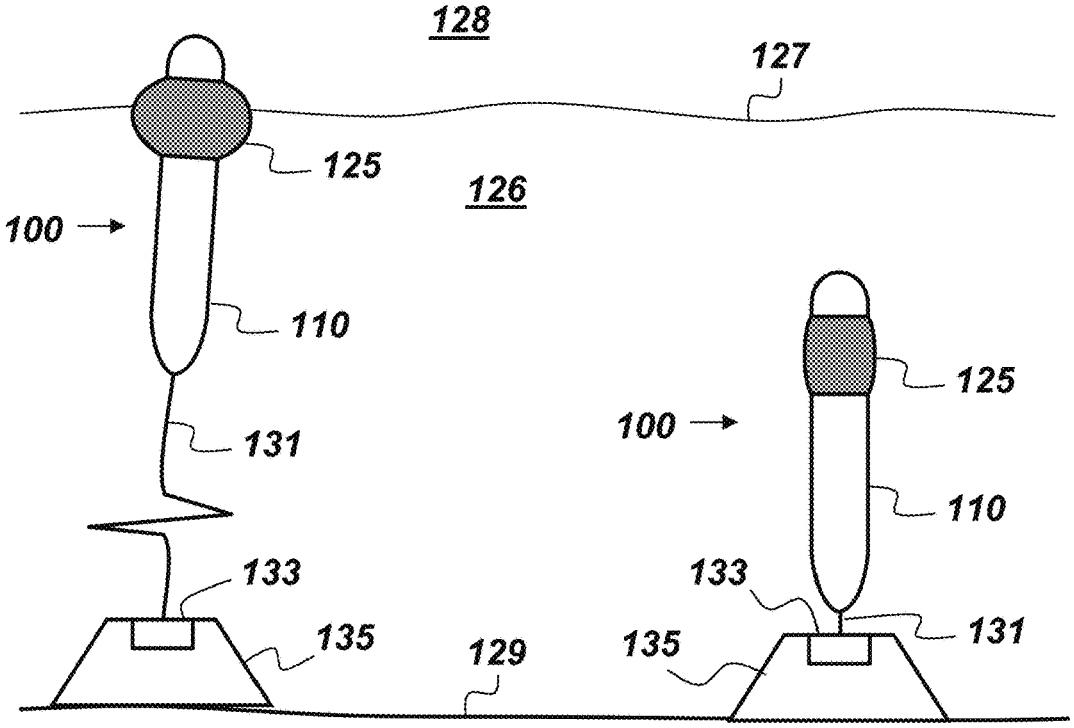
Fig. 2A
Fig. 2B
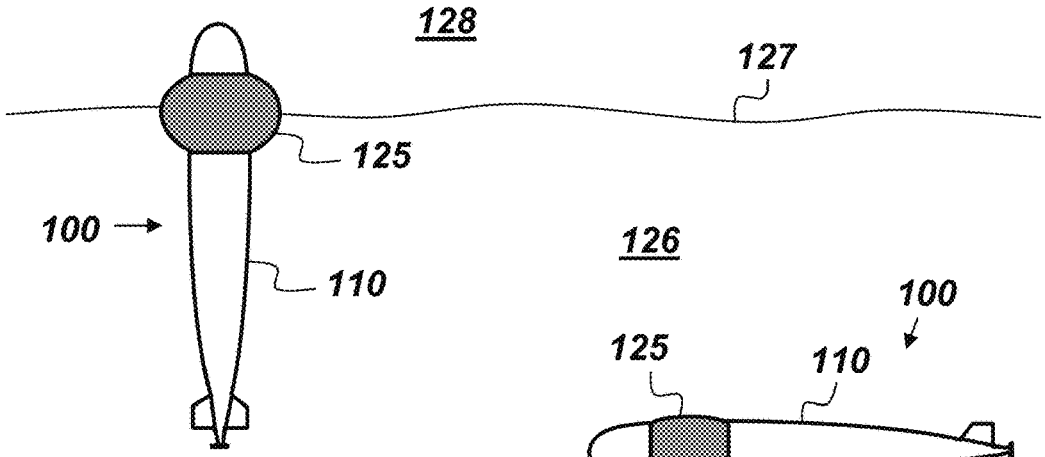
Fig. 2C
Fig. 2D

DEPTH-TOLERANT, INFLATABLE, VARIABLE-BUOYANCY BUOY

STATEMENT OF GOVERNMENT INTEREST

Federally-Sponsored Research and Development

The United States Government has ownership rights in this invention. Licensing inquiries may be directed to Office of Research and Technical Applications, Space and Naval Warfare Systems Center, Pacific, Code 72120, San Diego, Calif., 92152; telephone (619)553-5118; email: ssc_pac_t2@navy.mil. Reference Navy Case No. 103917.

BACKGROUND OF THE INVENTION

Field of Invention

This disclosure relates to buoys, and more particularly, depth-tolerant buoys.

Description of Related Art

Underwater buoys may be required to descend to, and ascend from, various underwater depths. As a result, it may be desirable to adjust the buoyancy of such buoys in order to accommodate the varying depths. There is a need for a reliable, variable-buoyancy buoy.

BRIEF SUMMARY OF INVENTION

Disclosed herein is a depth-tolerant, inflatable, variable-buoyancy buoy, comprising a body, an inflatable bladder, a bladder cover, a pressure vessel, a variable-volume, gas-filled chamber, a controller, a compressor, and a ballast. The body is substantially cylindrical having an upper end and a bottom end. Each of the top and bottom ends have tapered tips. The inflatable bladder is disposed around an exterior of the upper end of the body. The bladder cover surrounds the inflatable bladder. When the inflatable bladder is deflated, the bladder cover is configured to compress the inflatable bladder such that the inflatable bladder and the bladder cover substantially conform to an exterior contour of the body. The first pressure vessel is disposed within the body. The variable-volume, gas-filled chamber is mounted within the upper end of the body and exposed to an ambient pressure such that as the ambient pressure increases, the volume of the chamber decreases due to gas compression thus providing passive, variable buoyancy to the buoy. The controller is mounted within the first pressure vessel and is configured to control a transfer of compressible gas between the inflatable bladder and the first pressure vessel. The compressor is mounted within the first pressure vessel, operatively coupled to the inflatable bladder, and communicatively coupled to the controller. The compressor, upon receiving a signal from the controller, is configured to remove gas from the inflatable bladder, compress the removed gas, and introduce the compressed gas to the first pressure vessel, which is configured to function as a compressed gas storage. The ballast is mounted within the bottom end of the body so as to maintain a substantially vertical orientation of the buoy when the buoy is in water.

An embodiment of the depth-tolerant, inflatable, variable-buoyancy buoy may also be described as comprising: a substantially cylindrical body, an inflatable ring bladder, at least on pressure vessel, at least on volume-variable, gas-filled chamber, a controller, one or more compressors, a relief valve, a ballast, and a retractable mesh.

These, as well as other objects, features and benefits will now become clear from a review of the following detailed description, the illustrative embodiments, and the accompanying drawings.

BRIEF DESCRIPTION OF DRAWINGS

FIGS. 2A and 2B are side-views of an embodiment of a depth-tolerant, inflatable, variable-buoyancy buoy.

FIGS. 2C and 2D are side-views of an embodiment of a depth-tolerant, inflatable, variable-buoyancy buoy.

DETAILED DESCRIPTION OF THE INVENTION

Figure 1A:
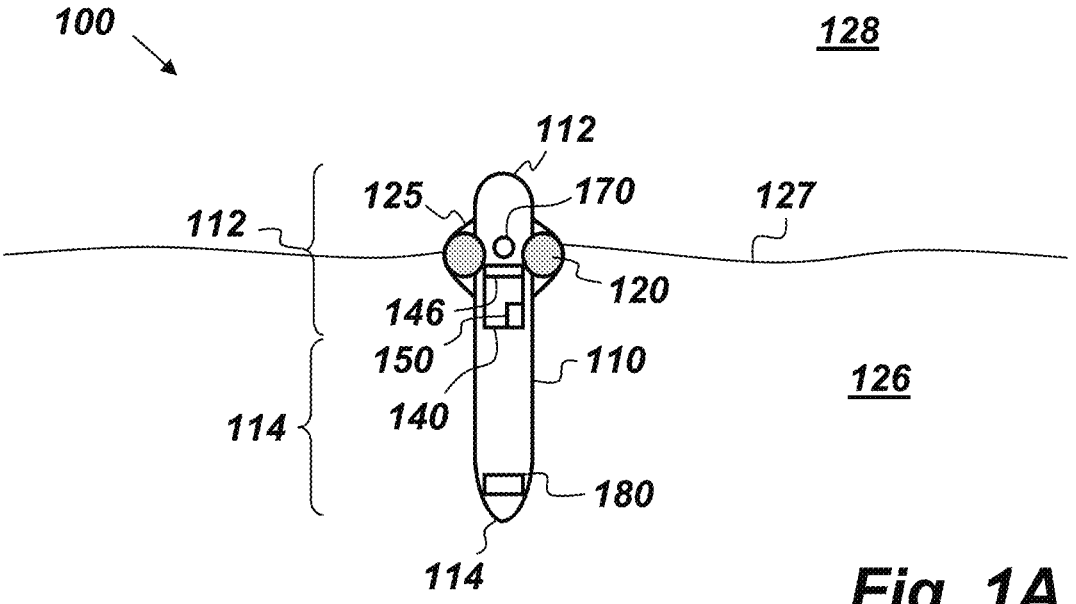
FIG. 1A is a cross-sectional view of an embodiment of a depth-tolerant, inflatable, variable-buoyancy buoy.
Figure 1B:
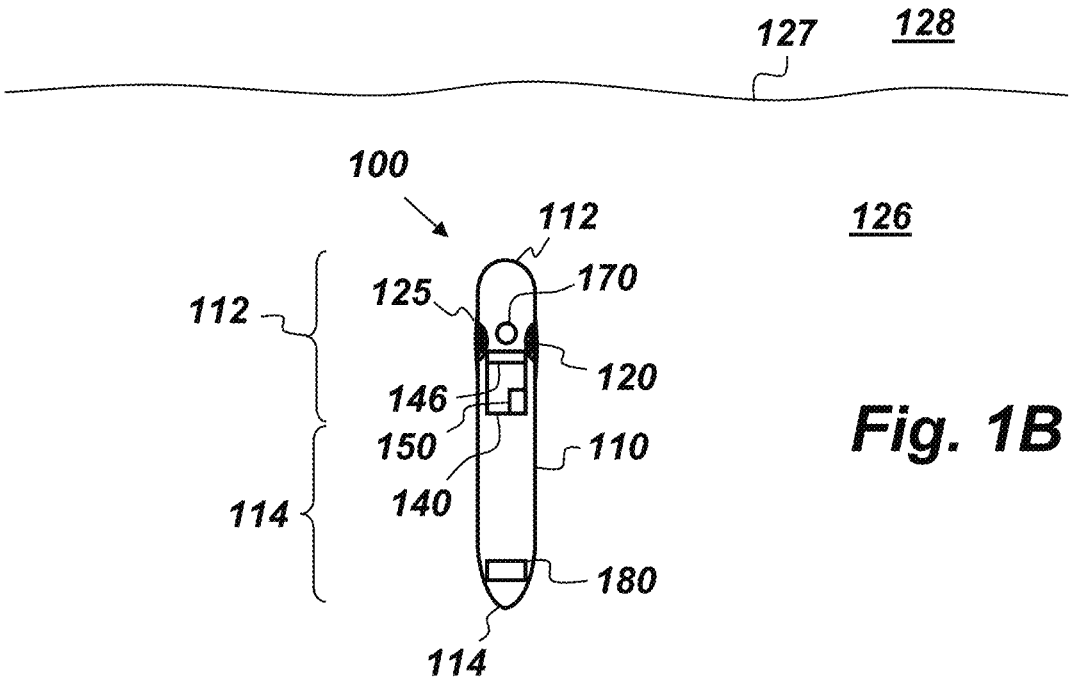
FIG. 1B is a cross-sectional view of an embodiment of a depth-tolerant, inflatable, variable-buoyancy buoy.

FIGS. 1A and 1B are cross-sectional views of an embodiment of a depth-tolerant, inflatable, variable-buoyancy buoy 100 (hereinafter referred to simply as the buoy 100). The buoy 100 comprises, consists of, or consists essentially of a body 110, an inflatable bladder 120, a bladder cover 125, a first pressure vessel 140, an optional variable-volume, gas-filled chamber 170, a controller 150, a compressor 146, and an optional ballast 180. The body 110 is substantially cylindrical having an upper end 112 and a bottom end 114. Each of the top and bottom ends 112 and 114 have tapered tips. The inflatable bladder 120 is disposed around an exterior of the upper end 112 of the body 110. The bladder cover 125 surrounds the inflatable bladder 120. When the inflatable bladder 120 is deflated, the bladder cover 125 is configured to compress the inflatable bladder 120 such that the inflatable bladder 120 and the bladder cover 125 substantially conform to an exterior contour of the body 110, as shown in FIG. 1B.

The first pressure vessel 140 is disposed within the body 110. The variable-volume, gas-filled chamber 170 is mounted within the upper end 112 of the body 110 and exposed to an ambient pressure such that as the ambient pressure increases, the volume of the chamber 170 decreases due to gas compression thus providing passive, variable buoyancy to the buoy 100. The controller 150 is mounted within the first pressure vessel 140 and is configured to control a transfer of compressible gas between the inflatable bladder 120 and the first pressure vessel 140. The compressor 146 is mounted within the first pressure vessel 140, operatively coupled to the inflatable bladder 120, and communicatively coupled to the controller 150. The compressor 146, upon receiving a signal from the controller 150, is configured to remove gas from the inflatable bladder 120, compress the removed gas, and introduce the compressed gas to the first pressure vessel 140, which is configured to function as a compressed gas storage. The ballast 180 is mounted within the bottom end 114 of the body 110 so as to maintain a substantially vertical orientation of the buoy 100 when the buoy is in water 126. FIG. 1A depicts the buoy 100 with the inflatable bladder 120 fully inflated such that the buoy 100 is floating at a waterline 127 (i.e., the interface between the water 126 and an atmosphere 128.

The buoy 100 is an active, variable-buoyancy buoy that permits the amount of buoyancy to be controlled on the fly, e.g., through inflation and/or deflation of the inflatable bladder 120. The buoy 100 may be moored or unmoored. The buoy 100 uses the compressor 146 and the controller 150 to remove air from the inflatable bladder 120, which in some embodiments is ring-shaped. The inflatable bladder 120 is designed to be held against the body 110 of the buoy 100 with the bladder cover 125. The bladder cover 125 may be any low-profile device capable of holding the deflated inflatable bladder 120 against the body 110 such that the bladder cover 125 and the inflatable bladder 120 substantially conform to the exterior surface of the body 110. Suitable examples of the bladder cover 125 include, but are not limited to, an elastic membrane, an outer retractable mesh, an elastic netting, and bay doors. When the inflatable bladder 120 is deflated, the bladder cover 125 helps the buoy 100 have a more stream-lined and smooth shape, which aids the buoy 100 in avoiding becoming entangled in kelp or other underwater hazards as the buoy 100 moves through the water.

Optionally, a check valve (such as check valves 260, 265, 270, 275 shown in FIG. 5) may prevent gas backflow during the deflation process. In the embodiment of the buoy 100 shown in FIG. 1, the inflatable bladder 120 is external to the buoy's body 110, but the inflatable bladder 120 may also be disposed in an internal pocket or enclosed space within the body 100 that is in fluid communication with the water. In other words, if the inflatable bladder 120 is disposed within an internal space of the body 110, the internal space may be a flooded space such that the water can fill the volume of the internal space as the inflatable bladder 120 deflates and such that the water can be forced from the internal space as the inflatable bladder inflates. The design of the buoy 100 allows the buoy 100 to remove as much gas from the inflatable bladder 120 as possible without endangering the bladder material from extrusion into the fill tube (i.e. the place where gas enters the bladder) at depth.

FIGS. 2A-2B show side view illustrations of a moored embodiment of the buoy 100. In this embodiment, the buoy 100 is moored to the floor 129 of the body of water 126 by an umbilical cable 131 that is anchored to the floor 129. The umbilical cable 131 may be used to allow the buoy 100 to rise and descend through the water 126. A winch 133 may be used to reel in or play out the umbilical cable 131. The winch 133 may be located in the buoy 100 or in a mooring base 135 (as shown in FIGS. 2A and 2B). The inflatable bladder 120 provides the majority of the net buoyancy for the buoy 100 required to float at the water surface 127. The inflatable bladder 120 can be deflated actively before the buoy 100 is required to descend back through the water column. The buoy 100 has a small net buoyancy to counter the winch 133 and umbilical 131. The buoy 100 can have a smaller winch, use less energy and afford a lighter, thinner umbilical tether or mooring line than required by prior art buoys.

A moored surface buoy should have a relatively high net buoyancy to limit overtopping by waves in higher sea states, and in the case of high surface current, being dragged under by the tension in the mooring. Thus, a buoy that is also required to ascend and descend in the water column would require a large relative force to bring it back down. By implementing an active variable buoyancy, the buoy 100 has the advantage of relatively large excess buoyancy at the surface, while having a significantly decreased net buoyancy for retraction, thus, saving energy and resources in design during descent while also keeping the outer hull of the buoy streamlined and relatively smooth for kelp shedding when in the reduced buoyancy state.

FIGS. 2C and 2D show a side-view illustration of an embodiment of the buoy 100 where the body 110 is the body of an unmanned, underwater vehicle (UUV). This UUV embodiment of the buoy 100 allows the UUV to more easily perform water-surface operations. To illustrate, the inflatable bladder 120 could inflate to turn a UUV into a surface craft, thus allowing for radio frequency or other communications without requiring the UUV to be actively driving upward to maintain surface operation. Once the UUV is finished, the inflatable bladder 120 would deflate causing the buoyancy of the UUV embodiment of the buoy 100 to decrease to near neutral or negative allowing the UUV embodiment of the buoy 100 to dive to a specified depth. This embodiment of the buoy 100 can then control its buoyancy to become near neutral so it would not expend extra energy to maintain its depth. Thus this embodiment of the buoy 100 would have a hybrid operation, spending part of its mission as a buoy and part as a roaming vehicle, and do so more efficiently than prior art solutions. Also, surfacing for pickup, if it is required, would be made easier as more of the UUV would be visible out of the water and sit higher for attaching an arresting hook or other method of capture. The buoy 100 is versatile. It may act as an umbilical moored buoy (such as shown in FIGS. 2A and 2B). It can be used to take data at the bottom of the floor of the body of water 126, such as the seafloor (as shown in FIG. 2D). The buoy 100 has a surface-riding feature in that it can remain at the surface for extended periods.

The variable-volume, gas-filled chamber 170 provides passive variable buoyancy to the buoy 100. Suitable examples of the variable-volume, gas-filled chamber 170 include, but are not limited to, passive foam, an expansion chamber that expands or contracts via regulated pressure or mechanical sliding of a pressure vessel with relative vacuum, and sealed gas-filled bladders that will lose buoyancy due to depth pressure as they are compressed. There is a diminishing return on design when considering scale. A passive-only system that relies on ambient depth pressure to decrease buoyancy still must contend with high buoyancy at the surface. Thus the retracting umbilical, winch and thus the spool must be larger to compensate for that transient operation. This may limit the amount of excess buoyancy that can be allowed at the surface.

Figure 3:
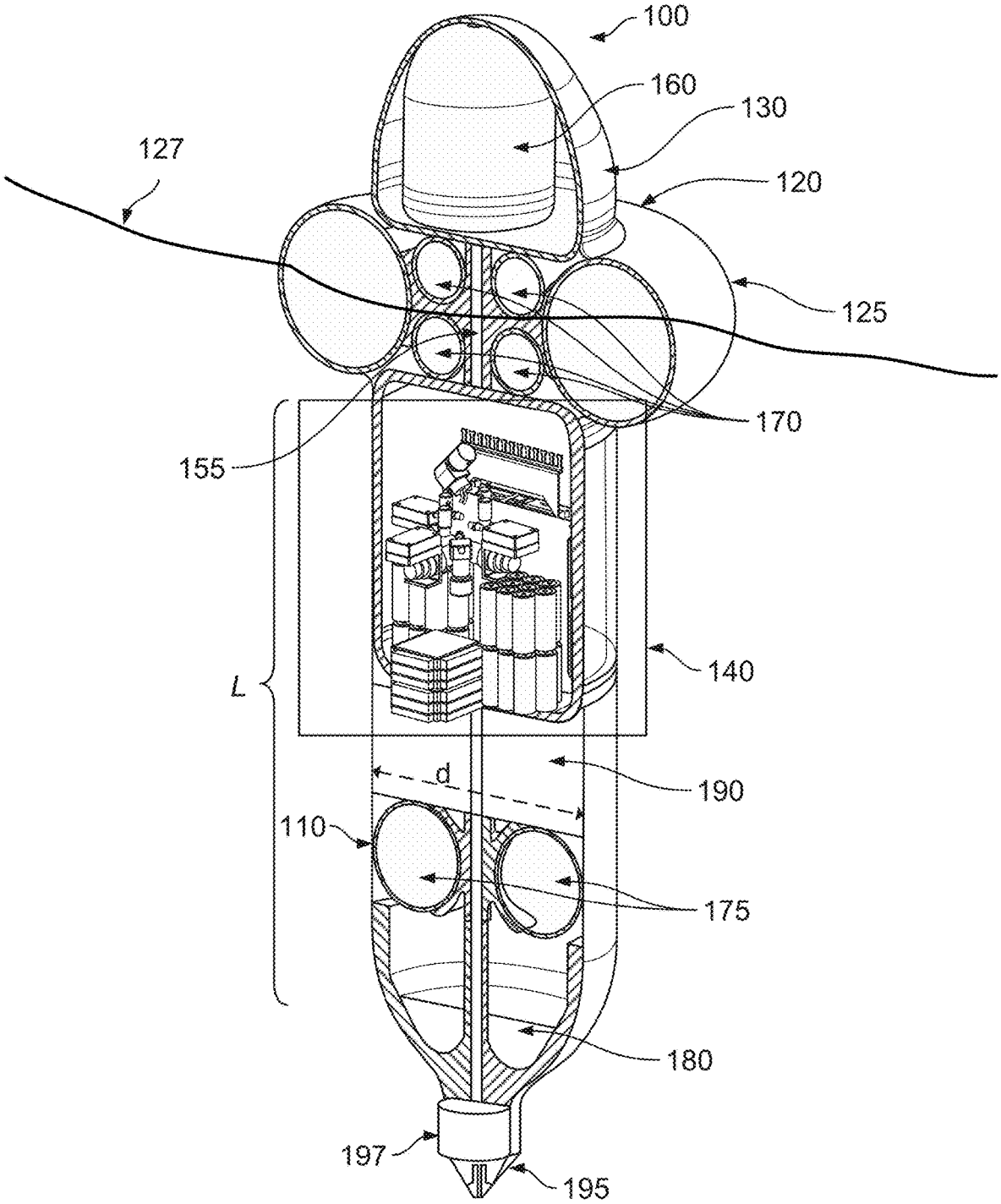
FIG. 3 is a cutaway view of a depth-tolerant, inflatable, variable buoyancy buoy in accordance with one embodiment of the present disclosure.
Figure 4:
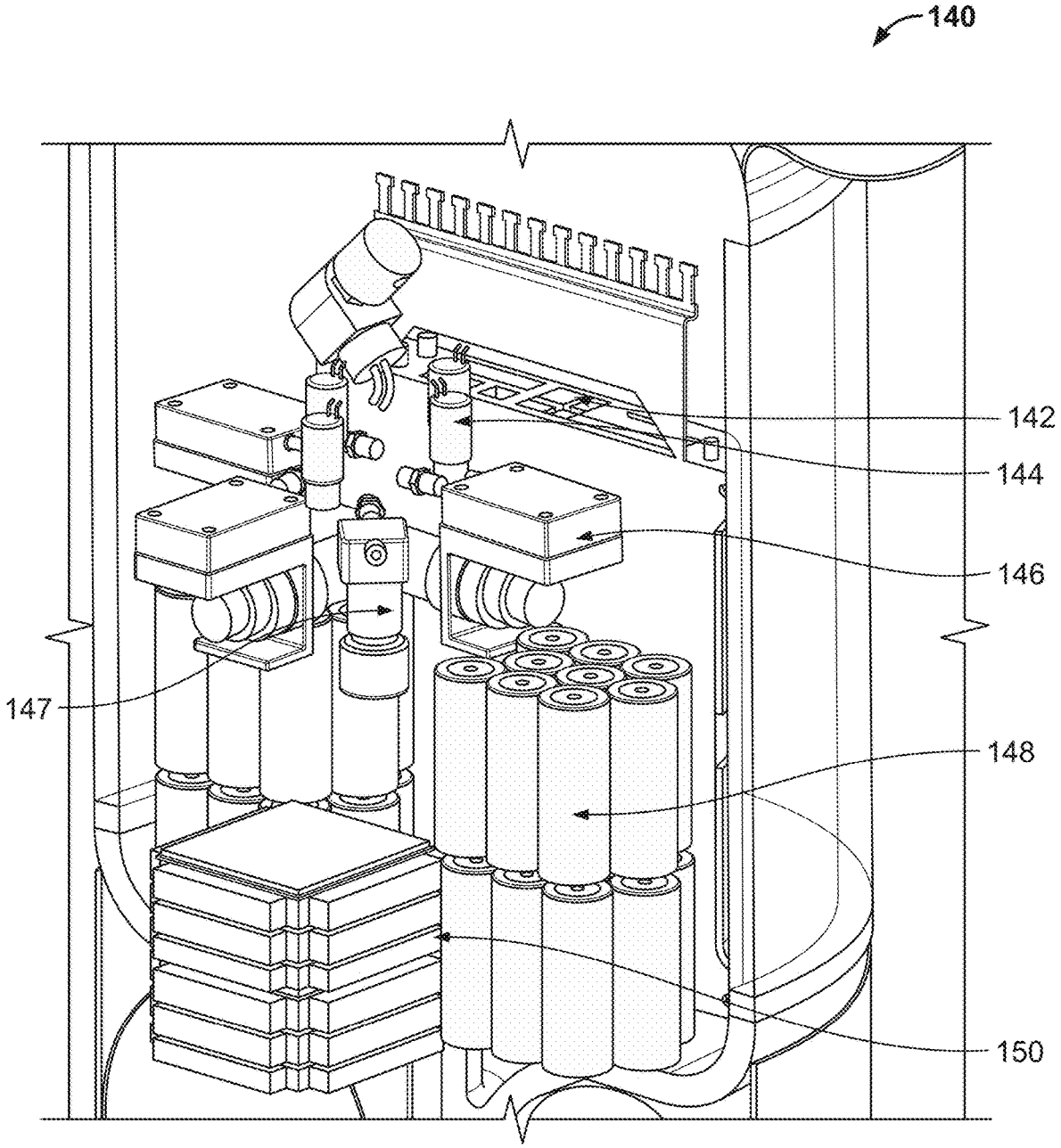
FIG. 4 is a cutaway detail view of the interior of a depth-tolerant, inflatable, variable buoyancy buoy in accordance with one embodiment of the present disclosure.

Referring now to FIGS. 3 and 4 together, illustrated are three-dimensional, cutaway views of an embodiment of the buoy 100 and the first pressure vessel 140 respectively. The embodiment of the buoy 100 shown in FIG. 3 includes the inflatable bladder 120 disposed around the body 110. In this particular embodiment, the inflatable bladder 120 takes on the shape of a ring. However, it should be understood that the inflatable bladder 120 could take on other configurations. In this embodiment, inflatable bladder 120 is essentially a tube that encircles the upper end 112 of the buoy 100, and prevents the buoy 100 from sinking. In this embodiment, the bladder cover 125 is a retractable mesh that surrounds the inflatable bladder 120. Retractable mesh is a flexible netting or membrane that is stretched over the inflatable bladder 120 to help the inflatable bladder 120 stay within the hull diameter of the buoy 100 when deflated. The retractable mesh is configured to keep the diameter of the inflatable buoy substantially constant when the inflatable bladder 120 is deflated. Waterline 127 shows approximately where the waterline would be when the buoy 100 is at the surface of the water 126, which is depicted in FIGS. 1A and 1B. There are many possible embodiments of the buoy 100, suitable examples of which include, but are not limited to, a surface-riding buoy and a spar buoy.

The embodiment of the buoy 100 shown in FIG. 3 also includes an upper pressure vessel 130 disposed within the body 110. The upper pressure vessel 130 may be composed of radio frequency transparent materials, and may share the same atmosphere with any other pressure vessel within the buoy 100, such as the first pressure vessel 140. In this embodiment of the buoy 100 includes a body 110 having a diameter (d) that is substantially constant through much of the length (L) of body 110.

FIG. 4 shows an enlarged view of the first pressure vessel 140 from the embodiment of the buoy 100 shown in FIG. 3. The first pressure vessel 140 shares the same atmosphere with the upper pressure vessel 130. In other words, the first pressure vessel 140 is fluidically coupled to the upper pressure vessel 130. The first pressure vessel 140 may be configured to house all the necessary electronics, batteries, and inflation dynamic components associated with the buoy 100. In the embodiment of the buoy 100 shown in FIGS. 3 and 4, these electronics include sensor or payload electronics 142, solenoids 144, compressors 146, relief valve 147, batteries 148 and controller 150.

The compressors 146 may be configured to remove air or other compressible gas from the inflatable bladder 120 to decrease buoyancy for the buoy 100 on descent, thus reducing a net buoyancy of the buoy 100. Mooring (such as is shown in FIGS. 2A and 2B) is a term of art and may include any location to which the position or movement of buoy 100 is maintained or restricted. Relief valve 147 is operably coupled to compressor 146. Relief valve 147 is capable of being set to allow a certain amount of gas (e.g., air) to additionally be compressed out of the inflatable bladder 120 as it descends.

Batteries 148 may provide a power supply for buoy 100. Alternatively, this power may be obtained from an umbilical (such as is shown in FIGS. 2A and 2B). Controller 150 is capable of starting and stopping a compressible gas supply to the at least one pressure vessel 130. In other words, the controller 150 controls the transfer of gas between the inflatable bladder 120 and the first and upper pressure vessels 140 and 130. The starting and stopping may occur in response to an activation/deactivation signal. In this embodiment, the controller 150 is a PC/104 board stack which includes a central processing unit (CPU) board, a power supply board and one or more peripheral boards. Upper pressure vessel 130 and first pressure vessel 140 may be connected by a tube 155 to maintain equilibrium and increase gas storage of the buoy 100.

A payload 160, such as a communication device, may reside in the upper pressure vessel 130. Payload 160 is configured to remain substantially above the waterline 127 when the buoy 100 is ata surface of a body of water. It is to be understood that the payload 160 may reside in other locations in addition to the upper pressure vessel 130. The payload 160 may be used to communicate with surface vessels or a satellite, for example. Payload electronics 142 may be stored in the first pressure vessel 140.

In addition to the variable-volume, gas-filled chamber 170, the embodiment of the buoy 100 shown in FIG. 3 depicts a lower variable-volume, gas-filled chamber 175, both chambers being configured to reduce the overall buoyancy of the buoy 100 as ambient pressure increases as the buoy 100 descends. In this embodiment, the variable-volume, gas-filled chambers 170 and 175 include a series or plurality of sealed, air-filled tubes providing passive, variable buoyancy to the buoy 100. The gas-filled chambers 170 and 175 may optionally be made of foam instead of air-filled tubes. The air content in these gas-filled chambers 170 and 175 is not changed in order to vary buoyancy. Rather, the volume is changed by the change in ambient pressure as the buoy ascends or descends. In this embodiment, the overall volume of the variable-volume, gas-filled chamber 170 is larger than the overall volume of the variable-volume, gas-filled chamber 175, but it is to be understood that in other embodiments of the buoy 100, the converse may be true.

The upper pressure vessel 130 and the first pressure vessel 140 are configured to store compressed gas that has been removed from the inflatable bladder 120 and to act as a reservoir for refilling inflatable bladder 120. The ballast 180 is configured to maintain a substantially vertical orientation of the buoy 100, so that it operates similarly to a spar buoy or as a surface-following buoy. The ballast 180 may be, e.g., a machined piece of lead or steel that sits in the bottom of a flooded area within the body 110, such as is shown in FIG. 3. The ballast 180 lowers the center of gravity of buoy 100 so that the center of buoyancy is higher than the center of gravity. The ballast 180 may be optional where the bottom of the buoy 100 is sufficiently heavy to lower the center of gravity below the center of buoyancy.

The embodiment of the buoy 100 shown in FIG. 3 also includes a fixed-volume float 190 that provides buoyancy to the buoy 100 that does not change or vary with depth or pressure changes. In addition to the inflatable bladder 120 and at least one variable volume, gas-filled chamber 170, depending on the buoyancy needed for any particular embodiment of the buoy 100, any combination may be used of fixed-volume floats 190 and additional variable-volume, gas-filled chambers 170 or 175. A suitable example of the fixed-volume float 190 is, but is not limited to, rigid syntactic foam. Syntactic foam is designed to not crush with increasing depth, while also permitting some buoyancy. Alternatively, to increase buoyancy, either or both the variable-volume, gas-filled chambers 170 and 175 may be replaced with a fixed-volume float 190. The fixed-volume float 190 is optional. The upper pressure vessel 130 and the first pressure vessel 140 also serve as fixed-volume floats and contribute to the overall buoyancy of the buoy 100.

Also depicted FIG. 3 is an optional hook 195 that is affixed to the ballast 180 to provide a mooring connection. An optional charge coil 197 is also shown for the buoy 100. The optional charge coil 197 allows the batteries 148 of the buoy 100 to be recharged at a charging station within the mooring base 135. The embodiment of the buoy 100 shown in FIG. 3 is shown with the inflatable bladder 120 fully inflated. When it is desired for the buoy 100 to recede under the water, the compressors 146 remove the air from the inflatable bladder 120 and the net buoyancy of the buoy 100 is reduced significantly or even made to be negatively buoyant. For example, for the embodiment of the buoy 100 shown in FIG. 3 at thirty-three (33) feet below the waterline 27, the total volume of the volume-variable, gas-filled chambers 170 and 175 was reduced to half of the total surface volume of the volume-variable, gas-filled chambers 170 and 175. By design, it would become increasingly easy to bring this buoy 100 down as it descends. Based on how much net buoyancy is desired at depth for a given embodiment of the buoy 100, the variable-volume, gas-filled chambers 170 and 175 could account for a large percentage of total buoyancy of the buoy 100. The variable buoyancy due to the variable-volume, gas-filled chambers 170 and 175 could also be made to account only for umbilical line tension at column depth or line weight, both of which typically increase with line payout. Thus, the buoy 100 may be used in applications requiring a constant buoyancy, as in the case of a consistent timed data collection.

Figure 5:
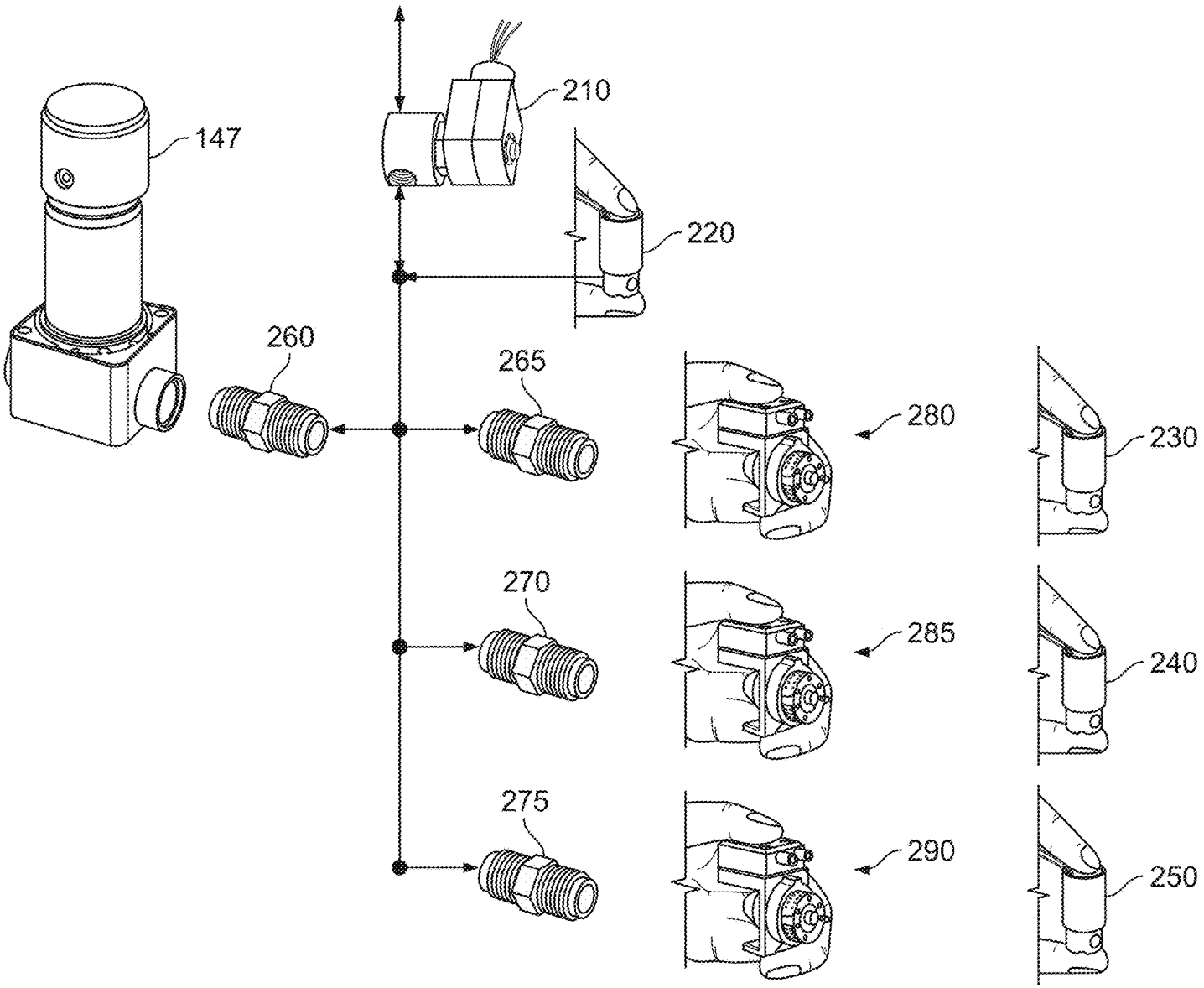
FIG. 5 shows inflation dynamics for the depth-tolerant, inflatable, variable buoyancy buoy in accordance with one embodiment of the present disclosure.

FIG. 5 includes illustrations of example inflation dynamics for the embodiment of the buoy 100 of FIGS. 3 and 4. It is to be understood that the descriptions below of the various elements depicted in FIGS. 3-5 are offered as examples only and the buoy 100 is not limited to these examples. FIG. 5 depicts relief valve 147, solenoid valves, 210, 220, 230, 240 and 250, check valves 260, 265, 270, 275 and flow control devices 280, 285, 290. In this embodiment, relief valve 147 is used to release air having a pressure of 0.5 to thirty (30) pounds per square inch (psi). Relief valve 147 allows for a passive air bleed to decompress the inflatable bladder 120 as it descends. Solenoid valve 210 aids in providing flood protection, and prevents partial deflation of the buoy 100 at the surface due to wave action. In this embodiment, the solenoid valve 210 has a maximum psi of five hundred (500), has a twenty-four Volt (24 V) direct current (DC) voltage, and operates at about 0.48 amps. Solenoid valves 220, 230, 240, 250 may operate at twelve volts (12 V) direct current voltage, and about 0.054 amps and may have a maximum rating of one hundred (100) psi. Check valves 260, 265, 270, 275 may prevent a reverse flow of air to allow for deflation of the inflatable bladder 120. Check valves 260, 265, 270, 275 may have a rating of one hundred twenty-five (125) psi at seventy degrees(70°) Fahrenheit. Check valves 260, 265, 270, 275 may have flow control devices 280, 285, 290 attached thereto that permit a flow of, for example, 0.16 cubic feet per minute (cfm) at the maximum psi, a full load of 2.3 milli-Amps at twelve (12) Volts direct current voltage, and a maximum psi of twelve (12) psi.

Referring now to FIGS. 3-5 together, on descent, solenoid valves 210, 230, 240, and 250 are opened, and all compressors 146 are turned on until the inflatable bladder 120 is deflated. Solenoid valves 210, 230, 240, and 250 may be activated and deactivated via a signal from the controller 150 or other activation/deactivation mechanisms, as are known in the art. Similarly, relief valve 147 may be activated and deactivated. In some embodiments, the relief valve 147 is passive (i.e., it is not actively powered or controlled), but opens and closes on its own due to ambient pressure conditions. The upper pressure vessel 130 and the first pressure vessel 140 are used in conjunction with the inflation components of FIG. 4 to store this removed volume and to act as a reservoir for refilling the inflatable bladder 120. The arrows shown in FIG. 5 indicate how air flows between the inflation components of FIG. 4 and the inflatable bladder (not shown in FIG. 5).

With solenoid valve 210 open and all other solenoid valves 220, 230, 240 and 250 closed, the relief valve 147 can be set to allow a certain amount of air to additionally be compressed out of the inflatable bladder 120 as the buoy 100 descends. When the inflatable bladder 120 is additionally deflated by the ambient pressure to a desired extent, solenoid valve 210 is closed and prevents the inflatable bladder 120 from being forced into an associated inflation tube. When the buoy 100 is at or near the water surface, solenoid valves 210 and 220 are opened with all other solenoid valves 230, 240, 250 closed. The opening and closing (or activation and deactivation) of solenoid valves 210, 220, 230, 240, 250 may be a result of a descent activation signal or an ascent activation signal from the controller 150. This will allow the compressed air in the upper pressure vessel 130 and/or the first pressure vessel 140 to re-inflate the inflatable bladder 120. Again, solenoid valve 210 can be closed to prevent compressive deflation of the inflatable bladder 120 due to wave action when the buoy 100 is at the water surface. To explain further, solenoid valve 210 prevents damage to the inflatable bladder 120 caused by being forced into the associated inflation tube. While descending, the relief valve 147 may remain open and not closed by controller 150. Solenoid valve 210 may be shut to fully prevent the extrusion of the inflatable bladder 120.

To explain further, with solenoid valve 210 open, further compression of the inflatable bladder 120 allows additional gas to be removed as the buoy 100 descends, beyond which is possible with the compressors 146. In one embodiment, the compressors 146 will stop removing gas when the pressure vessel 140 is about 12 psi (or whatever rating the compressors have that are ultimately used in a given embodiment). Once the compressors 146 stop working, there may still be additional gas left in the inflatable bladder 120. Having the buoy 100 descend with solenoid valve 210 open will help to further remove gas, but at some point the solenoid valve 210 must be shut. This may be accomplished by means of depth sensor, timer, pressure sensor within the pressure vessel 140 or other means. The relief valve 147 is set above a desired minimal value (as the check valve 260 is set to 1 psi or some other desired minimal number) to prevent wave action that could deflate the inflatable bladder 120 when solenoid valve 210 is open but all other solenoids are closed. Ultimately, for surface operation of the buoy 100, it may be desirable for all solenoids valves to be closed. Relief valve 147 is also a protection for the inflatable bladder 120 from being forced into a fill line when all solenoid valves are closed except for solenoid valve 210, the use of which is otherwise redundant and is not necessary for functioning of the system.

In sum, to inflate the inflatable bladder 120, open solenoid valves 210 and 220. Once inflated, close all solenoid valves. To deflate the inflatable bladder 120, open solenoid valves 210 and 230, 240, 250, plus turn on compressors 146. Once deflated, allow the buoy 100 to descend to some desired depth before closing all solenoid valves. The relief valve 147 keeps a differential pressure in the fill tube when all solenoid valves but solenoid valve 210 are closed and the buoy 100 is past a depth where ambient is greater than the absolute pressure of the pressure vessel 140. In one embodiment, it's possible to completely remove the relief valve 147. The relief valve 147 may be used as an extra way to deflate the inflatable bladder 120 without having the compressor solenoids 220, 230, 240, and 250 open while the compressors 146 are turned off.

Figure 6:
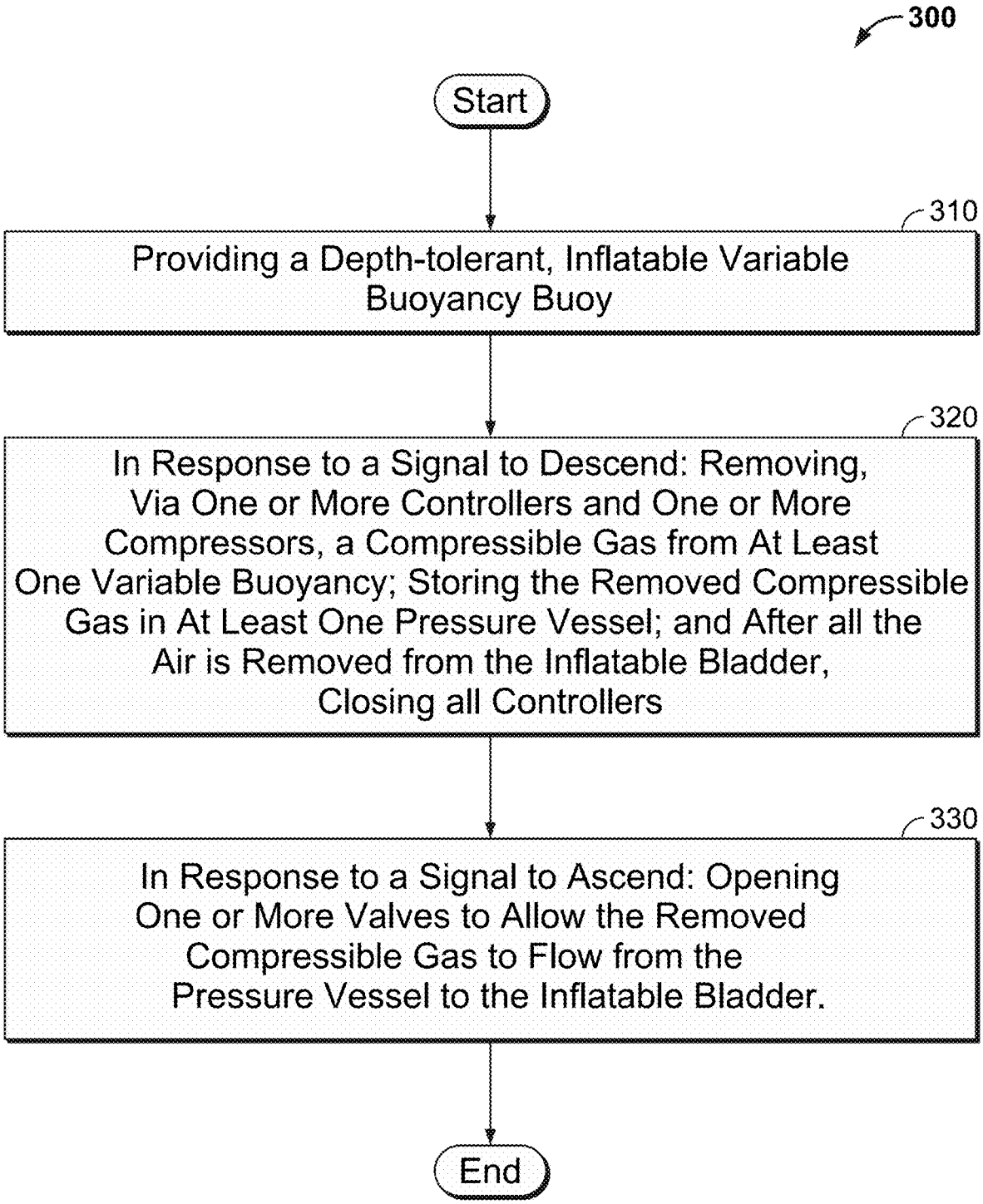
FIG. 6 is a method for deploying a depth-tolerant, inflatable, variable buoyancy buoy in accordance with one embodiment of the present disclosure.

FIG. 6 is a flowchart of a method 300 for deploying a depth-tolerant, variable-buoyancy buoy. It should be appreciated that fewer, additional, or alternative steps may also be involved in the process and/or some steps may occur in a different order.

At step 310, the method includes providing a depth-tolerant, inflatable-variable buoyancy buoy. At step 320, the method includes, in response to a descent activation signal, e.g., from one or more controllers or solenoids: removing, via one or more controllers and one or more compressors, a compressible gas from an inflatable bladder; storing the removed compressible gas in at least one pressure vessel; and after sufficient gas is removed (dependent on the desired rate of descent and desired depth) from the inflatable bladder, closing all solenoid valves thus deactivating the controllers.

At step 330, the method includes, in response to an ascent activation signal, opening one or more valves (such as the solenoid valves 210 and 220) to allow the removed compressible gas to flow from the pressure vessel to the inflatable bladder.

The buoy 100 and method 300 allow the user to save energy over prior art devices. The buoy 100 and method 300 also limit the need for heavier, more expensive and harder-to-handle umbilicals, winches, and associated equipment that would be required to tether and move more buoyant buoys. Unlike some prior art buoys, the buoy 100's initial reduction of buoyancy at the surface immediately reduces the net buoyancy. It could, in fact, reduce it to such an extent that the buoy would be negatively buoyant and sink on its own. Since the inflatable bladder 120 occupies a flooded pocket in the hull, or is external to the hull of the buoy 100 but can be brought within the diameter of the body 110 of the buoy with the bladder cover 125, the buoy 100 is less likely to become fouled by kelp or other hazards as the buoy 100 ascends or descends through the water column. Additionally, in embodiments of the buoy 100 where the bladder cover 125 keeps the inflatable bladder 120, when deflated, within the diameter of the body 110, this allows the buoy 100 to be stored in, captured by, docked in, and/or deployed from a cylindrical receptacle, such a torpedo tube or a cylindrical cavity at the mooring base 135 for example. The buoy 100 does not require rigid hull changes to vary its buoyancy, which reduces reliability concerns for long term deployment.

It will be understood that many additional changes in the details, materials, steps and arrangement of parts, which have been herein described and illustrated to explain the nature of the buoy 100, may be made by those skilled in the art within the principle and scope of the invention as expressed in the appended claims.

We claim:

1. A depth-tolerant, inflatable, variable-buoyancy buoy, comprising:

a body that is substantially cylindrical having an upper end and a bottom end, wherein each of the top and bottom ends have tapered tips;

an inflatable bladder disposed around an exterior of the upper end of the body;

a bladder cover surrounding the inflatable bladder, wherein when the inflatable bladder is deflated, the bladder cover is configured to compress the inflatable bladder such that the inflatable bladder and the bladder cover substantially conform to an exterior contour of the body;

a first pressure vessel disposed within the body;

a controller mounted within the first pressure vessel and configured to control a transfer of compressible gas between the inflatable bladder and the first pressure vessel; and a compressor mounted within the first pressure vessel, operatively coupled to the inflatable bladder, and communicatively coupled to the controller, wherein the compressor, upon receiving a signal from the controller, is configured to remove gas from the inflatable bladder, compress the removed gas, and introduce the compressed gas to the first pressure vessel, which is configured to function as a compressed gas storage.

2. The buoy of claim 1, further comprising:

a variable-volume, gas-filled chamber mounted within the upper end of the body and exposed to an ambient pressure such that as the ambient pressure increases, the volume of the chamber decreases due to gas compression thus providing passive, variable buoyancy to the buoy; and a ballast mounted within the bottom end of the body so as to maintain a substantially vertical orientation of the buoy when the buoy is in water.

3. The buoy of claim 2, further comprising a second variable-volume, gas-filled chamber mounted within the bottom end of the body and exposed to the ambient pressure such that as the ambient pressure increases the volume of the second chamber decreases due to gas compression thus providing further passive, variable buoyancy to the buoy.

4. The buoy of claim 3, further comprising a fixed-volume float mounted within the body.

5. The buoy of claim 4, wherein the fixed-volume float mounted within the body comprises syntactic foam.

6. The buoy of claim 2, wherein the variable-volume, gas-filled chamber is a gas-filled bladder.

7. The buoy of claim 2, wherein the buoy is tethered to a bottom of a body of water by a winch and an umbilical cable.

8. The buoy of claim 2, wherein the variable-volume, gas-filled chamber comprises foam.

9. The buoy of claim 1, wherein the bladder cover is an elastic membrane.

10. The buoy of claim 1, further comprising a second pressure vessel mounted within the upper end of the body between the tapered tip and the inflatable bladder such that the second pressure vessel is held substantially above a waterline when the inflatable bladder is fully inflated and the buoy is in water.

11. The buoy of claim 10, wherein the first pressure vessel is in fluid communication with the second pressure vessel.

12. The buoy of claim 11, wherein the controller is configured to function as a relief valve that allows for a passive bleed of gas to decompress the inflatable bladder as the ambient pressure increases.

13. The buoy of claim 1, wherein the body is the body of an unmanned, underwater vehicle (UUV) such that when the inflatable bladder is deflated the UUV is neutrally buoyant.

14. The buoy of claim 1, wherein the bladder cover comprises retractable netting.

15. The buoy of claim 1, wherein the body further comprises a flooded pocket in which the inflatable bladder fits when deflated.

16. A depth-tolerant, inflatable, variable-buoyancy buoy, comprising:

a substantially cylindrical body having tapered ends;

an inflatable ring bladder disposed around the perimeter of the body, wherein when the inflatable ring bladder is deflated, it causes the substantially cylindrical body to have a substantially constant diameter except for the tapered ends;

at least one pressure vessel disposed within the body;

a controller capable of starting and stopping a compressible gas supply to the at least one pressure vessel, wherein the at least one pressure vessel is configured to store the removed, compressed gas from the ring bladder;

one or more compressors coupled to the inflatable bladder and communicatively coupled to the controller, the one or more compressors being configured to remove gas from the inflatable bladder when the one or more compressors are activated by the controller, thus reducing a net buoyancy of the buoy;

a relief valve coupled to the one or more compressors, the relief valve being capable of causing additional gas to be compressed from the inflatable bladder as an ambient pressure increases; and a retractable mesh disposed around the inflatable ring bladder that substantially conforms to an exterior contour of the body when the inflatable ring bladder is deflated.

17. The buoy of claim 16, wherein the body is the body of an unmanned, underwater vehicle (UUV).

18. The buoy of claim 16, further comprising:

at least one volume-variable, gas-filled chamber mounted within the body and exposed to the ambient pressure such that as the ambient pressure increases the volume of the chamber decreases due to gas compression thus providing passive, variable buoyancy to the buoy; and a ballast configured to maintain a substantially vertical orientation of the buoy when the buoy is in use.

19. The buoy of claim 16, further comprising:

a payload disposed within the at least one pressure vessel, wherein the payload is configured to remain substantially above a waterline when the buoy is in use.

20. The buoy of claim 16, further comprising a solenoid valve mounted between the inflatable ring bladder and the one or more compressors, wherein the solenoid valve is configured to remain open until the ambient pressure reaches a given threshold at which point the solenoid valve closes, thereby preventing the deflated inflatable ring bladder from being pushed into the one or more compressors as the buoy descends in a body of water.

* * * * *